United States Patent [19]

Schreiber

[11] 4,004,809

[45] Jan. 25, 1977

[54] BOARD GAME APPARATUS

[75] Inventor: Gerald A. Schreiber, Bethany, Okla.

[73] Assignee: Bartholomew, Limited, Bethany, Okla.

[22] Filed: May 12, 1975

[21] Appl. No.: 576,334

[52] U.S. Cl. ..... 273/134 C; 273/134 AD; 273/137 AB

[51] Int. Cl.[2] ..... A63F 3/00

[58] Field of Search ..... 273/131, 134

[56] References Cited

UNITED STATES PATENTS

| | | | |
|---|---|---|---|
| 3,751,039 | 8/1973 | Dykoski | 273/131 AC |
| 3,806,125 | 4/1974 | Bialek | 273/131 AC |

FOREIGN PATENTS OR APPLICATIONS

| | | | |
|---|---|---|---|
| 1,270,021 | 7/1961 | France | 273/137 AB |
| 474,334 | 4/1929 | Germany | 273/137 AB |
| 841,559 | 6/1952 | Germany | 273/137 AB |
| 898,264 | 11/1953 | Germany | 273/137 AB |

*Primary Examiner*—Delbert B. Lowe

*Attorney, Agent, or Firm*—Laney, Dougherty, Hessin & Fish

[57] ABSTRACT

A board game apparatus comprising a game board with a playing surface divided into four playing areas surrounding a center section, each playing area comprising a plurality of playing spaces separated by open spaces having passage means therethrough and a starting and finishing space. A plurality of playing pieces are provided for each playing area and are combinable to define any of a plurality of playing entities for movement over the game board. Cards are provided for determining the identity and strength of each of the four playing entities, for determining the identities of opposing playing entities to be attacked, for providing defenses for each of the playing entities, and for indicating special moves for the playing entities over the game board. Playing indicia are provided for each playing area for movement between the center section and the starting and finishing spaces.

14 Claims, 50 Drawing Figures

BOARD GAME APPARATUS

BACKGROUND OF THE INVENTION

This invention relates generally to improvements in amusement devices or games, and more particularly, but not by way of limitation, to a partially chance-controlled game employing a game board.

SUMMARY OF THE INVENTION

The present invention contemplates a board game apparatus comprising a game board having a playing surface divided into a plurality of identical playing areas surrounding a center section, each playing area comprising a plurality of playing spaces separated by a plurality of walls having a plurality of passages therethrough, and a starting and finishing space. The apparatus further includes a plurality of playing pieces each associated and identifiable with a respective playing area, the plurality of playing pieces being combinable to define a playing entity positionable on and movable over the game board playing surface. Means are provided for determining the combination of the plurality of playing pieces to define a playing entity associated and identifiable with each playing area of the game board. Means are also provided for determining the identity of at least one playing entity to be attacked by each of the playing entities. Further, the apparatus includes means for providing each of the playing entities with a defense to the attack of at least one opposing playing entity, and means for determining the movement of the playing entities over the playing surface of the game board. Also included are a plurality of indicia means, each associated and identifiable with a respective playing area, for movement between the center section of the game board and the starting and finishing space of the respective playing area.

An object of the present invention is to provide an entertaining and amusing board game.

Another object of the invention is to provide an amusing board game combining chance and the skill of opposing players in the successful play thereof.

A further object of the invention is to provide an amusing board game requiring the successful completion of three tasks for one of the participants to win.

Other objects and advantages of the invention will be evident from the following detailed description when read in conjunction with the accompanying drawings.

DESCRIPTION OF THE PREFERRED EMBODIMENT

Figure 1:
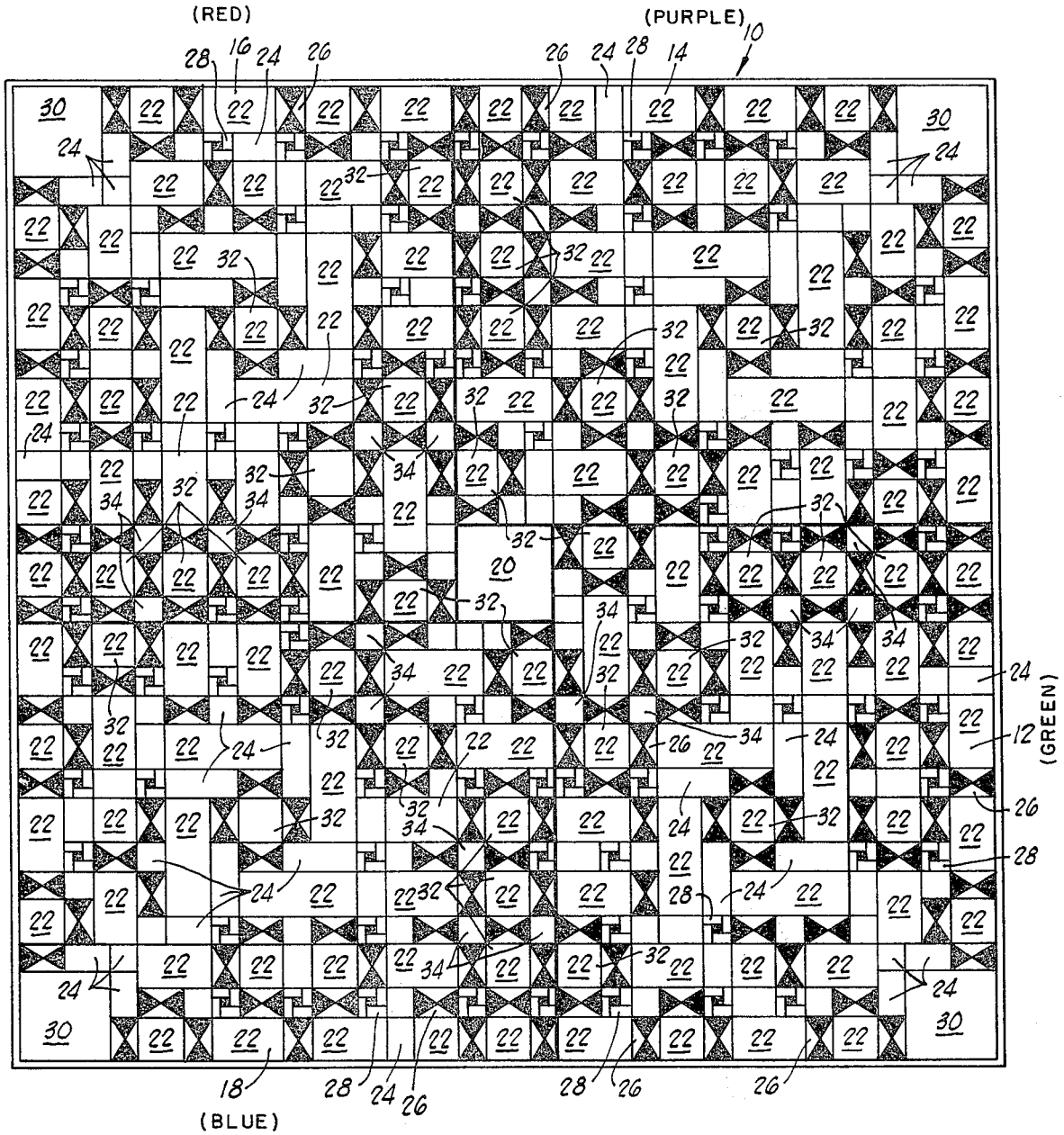
FIG. 1 is a plan view of the game board of the present invention illustrating the relation of the four playing areas thereof.

Referring now to the drawings, and to FIG. 1 in particular, the game board of the present invention is generally designated by the reference character 10. The game board 10 comprises four rectangular playing areas 12, 14, 16 and 18. The playing area 12 is designated as the "NOME of the Diorite Pyramid" and it is preferably predominantly green in color and is associated with the East. The playing area 14 is designated as the "NOME of the Obsidian Pyramid" and is predominantly purple in color and associated with the North. The playing area 16 is designated as the "NOME of the Granite Pyramid" and is predominantly red in color and is associated with the West. The playing area 18 is designated as the "NOME of the Basalt Pyramid" and is predominantly blue in color and is associated with the South.

The game board 10 is properly assembled as shown in FIG. 1 with the playing areas or NOMES 12, 14, 16 and 18 defining a square playing surface. The playing areas 12, 14, 16 and 18 surround a center section 20 designated as the PIT. Each of the playing areas 12, 14, 16 and 18 includes 34 playing spaces or GALLERIES 22 each separated from the next adjacent playing space 22 by one of a plurality of WALLS 24. A plurality of passages are formed in the WALLS 24 to permit passage therethrough from one playing space 22 to the next adjacent playing space 22. The passages of each playing area of the game board 10 include 55 GATES 26 and 21 HIDDEN WAYS 28.

Each playing area of the game board 10 further includes a starting and finishing space 30 positioned in one corner thereof. It will be seen that the four starting and finishing spaces 30 are positioned in the corners of the game board 10 when the playing areas or NOMES 12, 14, 16 and 18 are assembled as shown in FIG. 1. The starting and finishing space 30 of each NOME is designated as EARTH.

Each playing area of game board 10 includes eight special square playing spaces or GALLERIES 22 surrounded by four GATES 26 which are designated as SUN CHAMBERS and are indicated by the reference character 32. Also, each playing area of the game board 10 includes five special gates 34 designated as STAR GATES which occur at the junction of four GATES 26.

FIGS. 10A, 10B, 10C, 10D and 10E illustrate five cards used in playing the board game of the present invention which are designated as SPELL cards. Each of the playing areas or NOMES is furnished with an associated set of SPELL cards identifiable with the NOME preferably through color coding corresponding to the associated NOME. The SPELL cards for each NOME each identify a playing entity or OUTLANDER which will be described in detail hereinafter. Each SPELL card also discloses the essence of the particular playing entity on the face thereof.

Figure 10A:
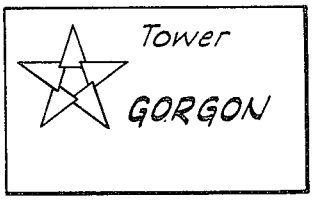
FIG. 10A, 10B, 10C, 10D and 10E illustrate the five SPELL cards of the present game apparatus associated with each playing area.

The SPELL card illustrated in FIG. 10A designates the playing entity GORGON, having a numerical value of seven, and the essence thereof which is TOWER. The SPELL card illustrated in FIG. 10B designates the playing entity DJINN, having a numerical value of six, and the essence associated therewith which is SMOKE. The SPELL card illustrated in FIG. 10C designates the playing entity DRAGON, having a numerical value of five, and the essence associated therewith which is FLAME. The SPELL card illustrated in FIG. 10D designates the playing entity TROLL, having a numerical value of four, and the essence associated therewith which is BRIDGE. The SPELL card illustrated in FIG. 10E designates the playing entity GNOME, having a numerical value of three, and the essence associated therewith which is VAULT.

FIGS. 11A, 11B, 11C, 11D and 11E illustrate five COUNTERSPELL cards one set of which is associated with each playing area or NOME and is preferably identifiable therewith by means of matching color coding. The COUNTERSPELL cards each designate a specific playing entity as discussed above, as well as indicating on the face thereof the nature of the COUNTERSPELL which will attack the associated playing entity.

Figure 11A:
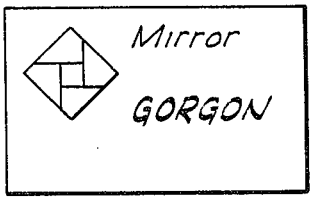
FIGS. 11A, 11B, 11C, 11D and 11E illustrate the five COUNTERSPELL cards of the present invention associated with each playing area.

The COUNTERSPELL card illustrated in FIG. 11A designates the playing entity GORGON, having a numerical value of seven, which is attacked by a MIRROR. The COUNTERSPELL card illustrated in FIG. 11B designates the playing entity DJINN, having a numerical value of six, which, when attacked, is forced into a BRASS BOTTLE. The COUNTERSPELL card illustrated in FIG. 11C designates the playing entity DRAGON, having a numerical value of five, which, when attacked, becomes a NEWT. The COUNTERSPELL card illustrated in FIG. 11D designates the playing entity TROLL, having a numerical value of four, which, when attacked, becomes a PEBBLE. The COUNTERSPELL card illustrated in FIG. 11E designates the playing entity GNOME, having a numerical value of three, which, when attacked, becomes a MOLE.

FIGS. 12A, 12B, 12C, 12D and 12E disclose five AMULET cards, one set of which is associated with each playing area and is identifiable therewith preferably by identical color coding. Each AMULET card identifies a corresponding playing entity for which it can provide protection.

Figure 12A:
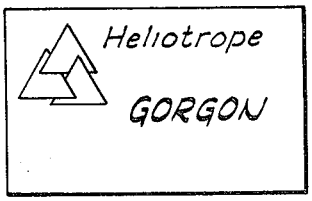
FIGS. 12A, 12B, 12C, 12D and 12E illustrate the five AMULET cards of the present invention associated with each playing area.
Figure 10B:
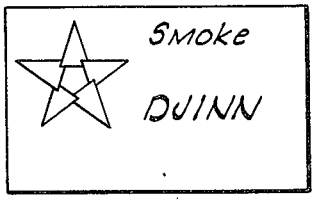
Figure 11B:
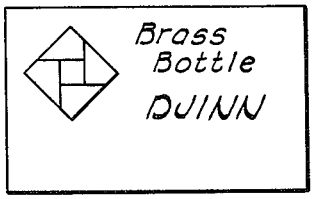
Figure 12B:
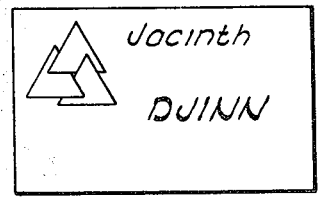
Figure 10C:
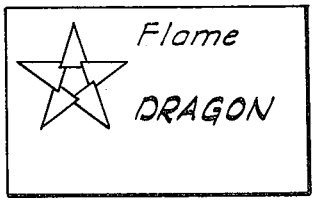
Figure 11C:
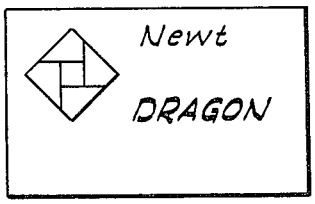
Figure 12C:
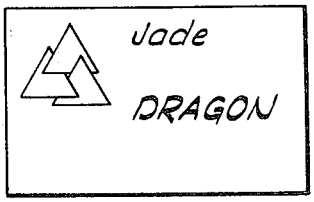
Figure 10D:
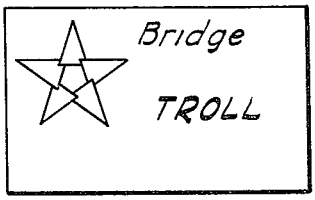
Figure 11D:
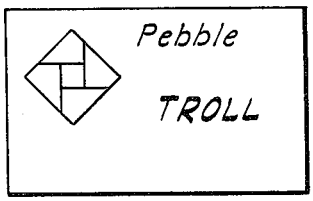
Figure 12D:
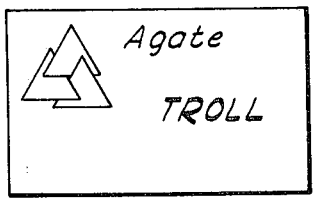
Figure 10E:
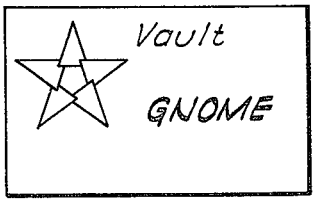
Figure 11E:
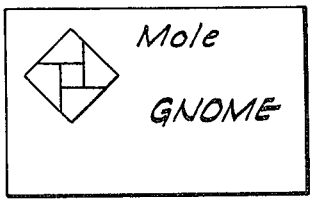
Figure 12E:
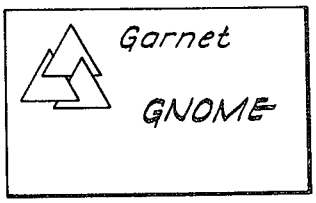

The HELIOTROPE AMULET card illustrated in FIG. 12A prevents annihilation of the playing entity GORGON, which has a numerical value of seven. The JACINTH AMULET card illustrated in FIG. 12B prevents annihilation of the playing entity DJINN, which has a numerical value of six. The JADE AMULET card illustrated in FIG. 12C prevents annihilation of the playing entity DRAGON, which has a numerical value of five. The AGATE AMULET card illustrated in FIG. 12D prevents annihilation of the playing entity TROLL, which has a numerical value of four. The GARNET AMULET card illustrated in FIG. 12E prevents annihilation of the playing entity GNOME, which has a numerical value of three.

FIGS. 2, 3A, 3B, 4A and 4B illustrate the various playing pieces used in playing the board game of the present invention. Each playing piece is preferably in the form of a rectangular parallelepiped having a height of approximately one-half inch and a width and length of approximately seven-eighths inch. It will be understood that the width and length of each playing piece is approximately equal to the width and length of each square playing space or GALLERY 22 of the game board 10. It will also be understood that other configurations of playing pieces may be employed in the board game of the present invention if desired.

Figure 2:
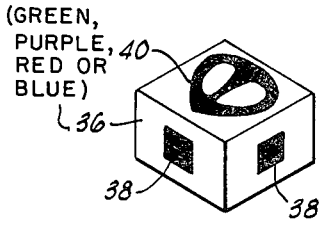
FIG. 2 is a perspective view of the TRAKUS playing piece having a numerical value of one and illustrating the GNOME symbol on one side thereof.

The playing piece 36 illustrated in FIG. 2 is designated as a TRAKUS and carries a numerical value of one. The numerical value is indicated on each side of the playing piece 36 by the single square 38. The playing piece 36 carries the symbol of the playing entity GNOME on the top side and on the bottom side thereof as shown at 40. Each playing area or NOME of the game board 10 is provided with three TRAKUS playing pieces 36 associated therewith and identifiable therewith by means of identical color coding.

Figure 3A:
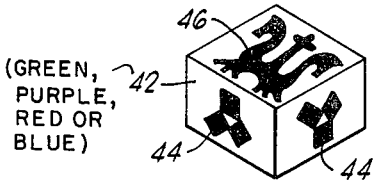
FIG. 3A is a perspective view of the TRUIN playing piece having a numerical value of three and illustrating the GORGON symbol on one side thereof.
Figure 3B:
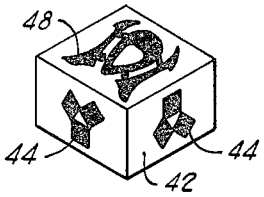
FIG. 3B is a perspective view of the TRUIN playing piece of FIG. 3A illustrating the DJINN symbol on the opposite side thereof.

FIGS. 3A and 3B illustrate the playing piece 42 which is designated as a TRUIN. The playing piece 42 carries a numerical value of three which is indicated on each side thereof by the triangularly arranged three squares 44. The top side of the TRUIN playing piece 42 displays the symbol 46 of the playing entity GORGON thereon as shown in FIG. 3A. The opposite or bottom side of the playing piece 42 displays the symbol 48 of the playing piece DJINN thereon. Each playing area of the game board 10 is provided with one TRUIN playing piece 42 associated therewith and identifiable therewith by corresponding color coding.

Figure 4A:
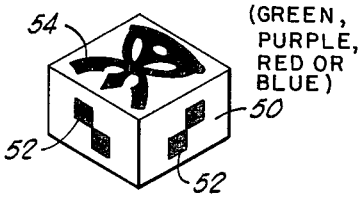
FIG. 4A is a perspective view of the TROVEN playing piece having a numerical value of two and illustrating the DRAGON symbol on one side thereof.
Figure 4B:
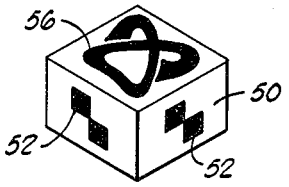
FIG. 4B is a perspective view of the TROVEN playing piece of FIG. 4A illustrating the TROLL symbol on the opposite side thereof.

The playing piece 50 illustrated in FIGS. 4A and 4B is designated as a TROVEN and carries the numerical value of two which is indicated thereon by the pair of squares 52 on each of the four sides thereof. The top side of the playing piece 50 displays the symbol 54 of the playing entity DRAGON as illustrated in FIG. 4A. The bottom side of the playing piece 50 displays the symbol 56 of the playing piece TROLL. Each playing area of the game board 10 is provided with two TROVEN playing pieces 50 associated therewith and identifiable therewith by corresponding color coding.

Figure 5:
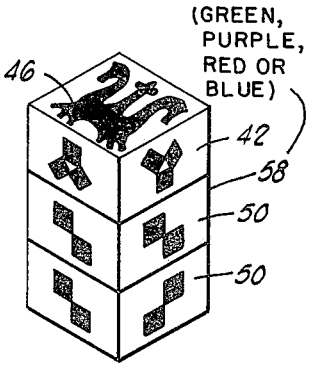
FIG. 5 illustrates the GORGON playing entity having a numerical value of seven and consisting of two TROVEN playing pieces and one TRUIN playing piece.

FIG. 5 illustrates the playing entity GORGON designated by the reference character 58 which consists of two stacked TROVEN playing pieces 50 topped by one TRUIN playing piece 42 with the GORGON symbol 46 thereof facing upwardly. The numerical value of the GORGON playing entity is seven and is the sum of the numerical values of the two TROVEN playing pieces 50 and the TRUIN playing piece 42.

Figure 6:
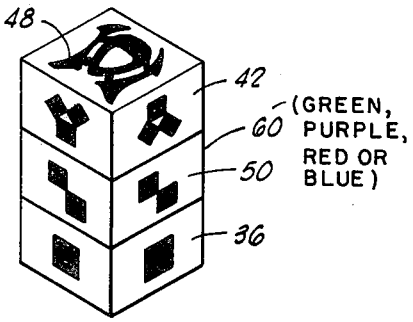
FIG. 6 illustrates the DJINN playing entity having a numerical value of six and consisting of one TRAKUS playing piece, one TROVEN playing piece and one TRUIN playing piece.

FIG. 6 illustrates the playing entity DJINN designated by the reference character 60 which consists of a stack of one TRAKUS playing piece 36, one TROVEN playing piece 50 topped by one TRUIN playing piece 42 displaying the DJINN symbol 48 on the upper side thereof. The numerical value of the DJINN playing entity is six which is the sum of the numerical values of the three playing pieces 36, 50 and 42 forming the playing entity 60.

Figure 7:
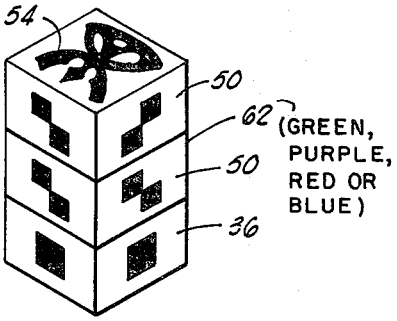
FIG. 7 illustrates the DRAGON playing entity having a numerical value of five and consisting of one TRAKUS playing piece and two TROVEN playing pieces.

FIG. 7 illustrates the playing entity DRAGON designated by the reference character 62. The DRAGON playing entity 62 consists of a vertical stack of one TRAKUS playing piece 36 and one TROVEN playing piece 50 topped by a third TROVEN playing piece 50 displaying the DRAGON symbol 54 on the upper side thereof. The numerical value of the DRAGON playing entity is five which is the sum of the individual numerical values of the three playing pieces comprising the DRAGON playing entity 62.

Figure 8:
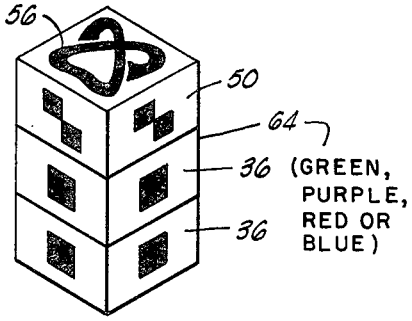
FIG. 8 illustrates the TROLL playing entity having a numerical value of four and consisting of two TRAKUS playing pieces and one TROVEN playing piece.

FIG. 8 illustrates the playing entity TROLL designated by the reference character 64. The TROLL playing entity 64 consists of a stack of two TRAKUS playing pieces 36 topped by a TROVEN playing piece 50 displaying the TROLL symbol 56 on the upper side thereof. The numerical value of the TROLL playing entity is four which is the sum of the individual numerical value of the three playing pieces comprising the TROLL playing entity 64.

Figure 9:
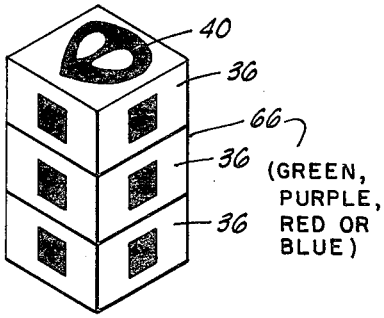
FIG. 9 illustrates the GNOME playing entity having a numerical value of three and consisting of three TRAKUS playing pieces.

FIG. 9 illustrates the playing entity GNOME designated by the reference character 66. The GNOME playing entity 66 consists of a vertical stack of three TRAKUS playing pieces 36. The GNOME symbol 40 is displayed on the upper side of the uppermost TRAKUS playing piece 36. The numerical value of the GNOME playing entity is three which is the sum of the individual numerical values of the three TRAKUS playing pieces 36 comprising the GNOME playing entity 66.

In the playing of the board game of the present invention, it will be understood that each of the five playing entities illustrated in FIGS. 5, 6, 7, 8 and 9 is generally known as an OUTLANDER. The numerical value of each OUTLANDER is an indication of its relative strength, with the GORGON OUTLANDER or playing entity 58, having a numerical value of seven, being the most powerful and with the GNOME OUTLANDER or playing entity 66, having a numerical value of three, being the least powerful. Each playing area or NOME of the game board 10 is assigned a playing entity or OUTLANDER in one of the five forms described above in a manner which will be described hereinafter.

FIGS. 13A, 13B, 13C, 13D, 13E, 13F, 13G and 13H each illustrate one of the eight ABILITY cards used in playing the board game of the present invention. One set of each of the eight cards illustrated in FIGS. 10A through 10E is furnished with and associated with each of the four playing areas or NOMES and is identifiable with the respective playing area preferably through color coding corresponding to the associated playing area.

Figure 13A:
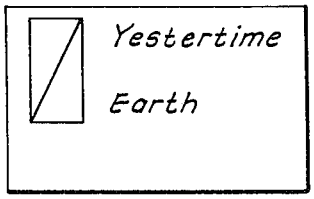
FIGS. 13A, 13B, 13C, 13D, 13E, 13F, 13G and 13H illustrate the eight ABILITY cards of the present invention associated with each playing area.

The ABILITY card illustrated in FIG. 13A is designated as YESTERTIME and provides for movement of a playing entity or OUTLANDER from any spot on the game board to the starting and finishing space or EARTH 30 of its associated playing area or NOME.

Figure 13B:
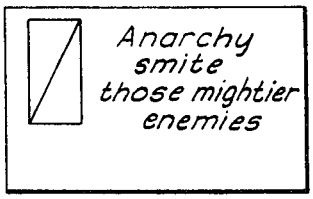

The ABILITY card illustrated in FIG. 13B is designated as ANARCHY and provides its associated playing entity or OUTLANDER with the ability to attack an opposing OUTLANDER of greater strength as indicated by a higher numerical value.

Figure 13C:
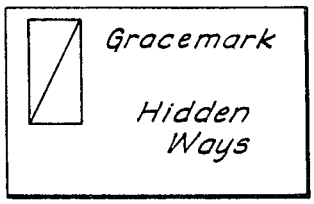

The ABILITY card illustrated in FIG. 13C is designated as GRACEMARK. The GRACEMARK ABILITY card permits its associated OUTLANDER to move from one playing space or GALLERY 22, adjacent a HIDDEN WAY 28, through the adjacent HIDDEN WAY 28 into the next adjacent playing space or GALLERY 22.

Figure 13D:
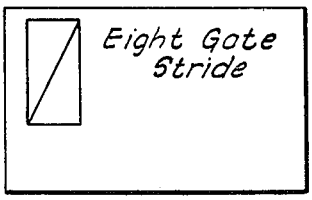

The ABILITY card illustrated in FIG. 13D is designated as EIGHT GATE STRIDE. The EIGHT GATE STRIDE ABILITY card permits its associated OUTLANDER to pass through eight GATES 26 on the game board 10 in one turn. However, the associated OUTLANDER may not pass through the same gate twice in such a move.

Figure 13E:
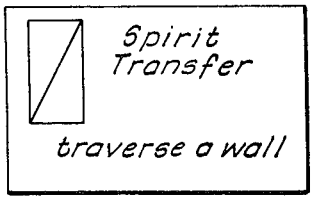

The ABILITY card illustrated in FIG. 13E is designated as SPIRIT TRANSFER. The SPIRIT TRANSFER ABILITY card permits its associated OUTLANDER to pass from one playing space or GALLERY 22 to the next adjacent playing space or GALLERY 22 through a WALL 24 having no GATE 26 therein.

Figure 13F:
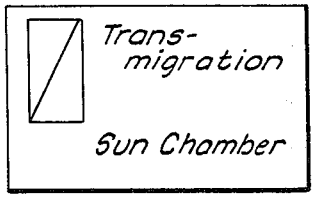

The ABILITY card illustrated in FIG. 13F is designated as TRANSMIGRATION. The TRANSMIGRATION ABILITY card permits its associated OUTLANDER to move from any SUN CHAMBER 32 on the game board 10 to any other SUN CHAMBER 32 on the game board.

Figure 13G:
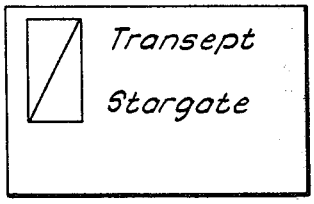

The ABILITY card illustrated in FIG. 13G is designated as TRANSEPT. The TRANSEPT ABILITY card permits its associated OUTLANDER to move from any playing space or GALLERY 22 adjacent a STAR GATE 34 on the game board 10 to any other playing space or GALLERY 22 adjacent any other STAR GATE 34.

Figure 13H:
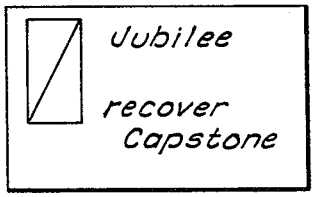
Figure 15A:
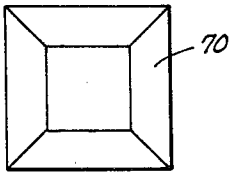
FIG. 15A illustrates one of four PYRAMIDS associated with each playing area.
Figure 15B:
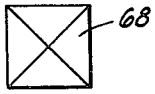
FIG. 15B illustrates one of four PYRAMID CAPSTONES associated with each PYRAMID and corresponding playing area.

The ABILITY card illustrated in FIG. 13H is designated as JUBILEE. The JUBILEE ABILITY card permits its associated OUTLANDER, when positioned in a playing space or GALLERY 22 adjacent the center section or PIT 20 of the game board 10, to secure the CAPSTONE 68, as illustrated in FIG. 15B, associated and identifiable with the NOME of that OUTLANDER from the PIT 20. The significance of the JUBILEE ABILITY card will become clear when the playing of the board game of the present invention is described in detail hereinafter.

It should be understood at this point, however, that each playing area or NOME 12, 14, 16 and 18 is provided with a CAPSTONE 68, preferably identifiable therewith by color coding, for the playing of the game. In a similar manner, each playing area or NOME is also provided with a PYRAMID 70, as illustrated in FIG. 15A, which is preferably identifiable therewith by a corresponding color code. In the playing of the game, as will be described hereinafter, one of the objects for each of the contestants participating will be to secure the associated CAPSTONE 68 from the PIT 20 and position it on top of the corresponding PYRAMID 70 in the starting and finishing space or EARTH 30 to complete the construction thereof.

Figure 14A:
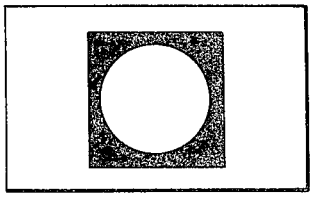
FIGS. 14A, 14C, 14E, 14G, 14I, 14K and 14M, illustrate the seven different positive DJER cards of the present invention.
Figure 14C:
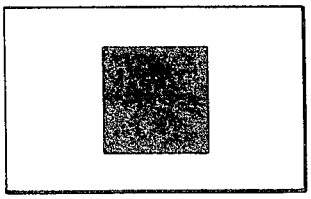
Figure 14E:
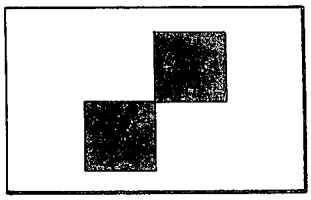
Figure 14B:
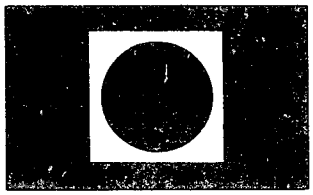
FIGS. 14B, 14D, 14F, 14H, 14J, 14L and 14N illustrate the seven different negative DJER cards of the present invention.
Figure 14D:
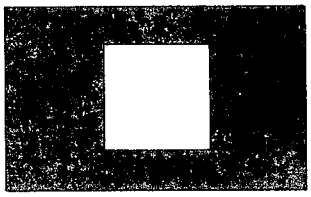
Figure 14F:
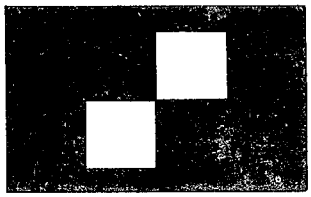
Figure 14G:
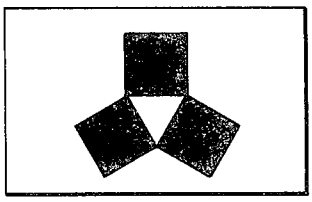
Figure 14I:
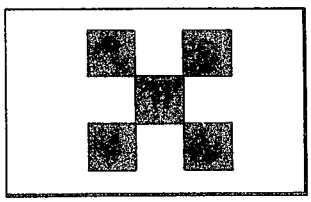
Figure 14K:
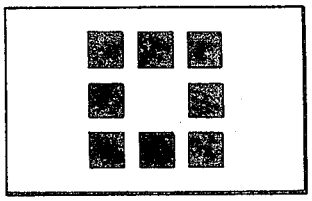
Figure 14H:
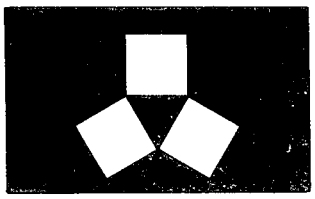
Figure 14J:
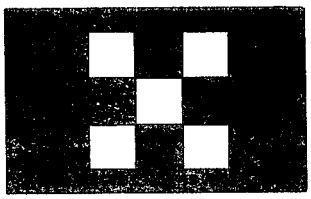
Figure 14L:
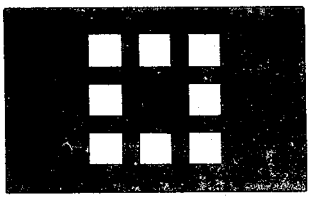
Figure 14M:
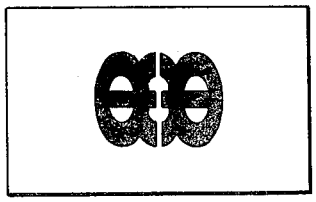
Figure 14N:
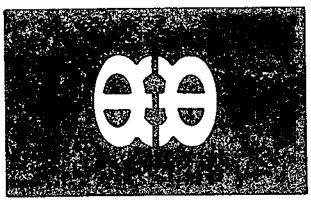

FIGS. 14A, 14B, 14C, 14D, 14E, 14F, 14G, 14H, 14I, 14J, 14K, 14L, 14M and 14N illustrate the various positive and negative mover or DJER cards employed in the playing of the board game of the present invention. The DJER cards are used in the playing of the game to determine the movement of each OUTLANDER over the game board 10. FIGS. 14A, 14C, 14E, 14G, 14I and 14K disclose positive mover or DJER cards having numerical values of zero, one, two, three, five and eight, respectively. There are nine of each of these six positive DJER cards in the DOMAIN of positive symbols. The DOMAIN of positive symbols further includes a single special positive DJER card as illustrated in FIG. 14M. The total number of cards in the positive DOMAIN is therefore 55. FIGS. 14B, 14D, 14F, 14H, 14J and 14L illustrate the DJER cards of the negative DOMAIN having values of zero, one, two, three, five and eight, respectively. The negative DOMAIN comprises nine of each of these six negative DJER cards. The negative DOMAIN further includes one special negative DJER card as illustrated in FIG. 14N. The total number of cards in the negative DOMAIN is therefore also 55.

In the playing of the game, the positive and negative DOMAINS of DJER cards are separated and are shuffled and stacked face-down in random order. As will be explained in more detail hereinafter, the top cards on the two DOMAINS of DJER cards are simultaneously turned up or CAST to provide a determination of the number of GATES through which a participant's OUTLANDER may pass during his turn of play. The single special card in each DOMAIN is designated as DJER and is a free choice card which permits a participant's OUTLANDER to move to any GALLERY 22 in the playing area or NOME 12, 14, 16 or 18 in which the OUTLANDER is resting.

THE PLAYING OF THE GAME

In the playing of the board game of the present invention, there are three basic objectives for each participant. The first participant to accomplish all three basic objectives is the winner of the game.

Each participant is designated as a NOMARCH and is assigned a specific one of the playing areas or NOMES 12, 14, 16 or 18 prior to the start of play. Two of the NOMARCH'S campaign objectives are to send forth his OUTLANDER into the three enemy lands or NOMES where the NOMARCH'S OUTLANDER must accomplish two deeds of bravery and craft in defeating the NOMARCH'S enemies. As a third campaign objective, the NOMARCH'S OUTLANDER must recover the long missing CAPSTONE 68 associated with the NOME PYRAMID 70 and position the CAPSTONE on the PYRAMID in the starting and finishing space or EARTH 30 of the NOMARCH'S NOME to restore the PYRAMID to its former glory.

To begin the game each NOMARCH is assigned a specific NOME and an associated PYRAMID and CAPSTONE. He is also provided with one TRUIN 42, two TROVEN 50 and three TRAKUS 36. From these playing pieces, one of the five OUTLANDERS, previously described, is assembled. This assembly of playing pieces to form one of the five OUTLANDERS is called TRANSMOGRIFICATION.

Each NOMARCH is also provided with a set of SPELL cards, a set of COUNTERSPELL cards and a set of AMULET cards, as described above, associated with and preferably color coded in correspondence with his NOME. In a similar manner, each NOMARCH is provided with a color coded set of eight ABILITY cards corresponding to his NOME.

To start the game, the board 10 is assembled as shown in FIG. 1 and each participant or NOMARCH shuffles his SPELL cards and places them in a stack face-down in front of him. Each NOMARCH shuffles his COUNTERSPELL cards and stacks them face-down in front of him, withdrawing two COUNTERSPELL cards and discarding the remaining three COUNTERSPELL cards. The NOMARCH looks at the two COUNTERSPELL cards drawn from the stack but does not reveal them to his opponents.

Each NOMARCH then shuffles his AMULET cards and places them in a stack in front of him withdrawing three AMULET cards and discarding the remaining two AMULET cards. The NOMARCH looks at the three AMULET cards withdrawn from the stack but does not reveal the identity of these cards to his opponents.

Each NOMARCH then withdraws the JUBILEE card from the deck of ABILITY cards color coded to his NOME. Each NOMARCH then shuffles the remaining ABILITY cards, placing them in a stack in front of him, withdrawing five ABILITY cards and discarding two remaining ABILITY cards. The five ABILITY cards withdrawn from the stack are displayed in a manner visible to all opponents.

Each participant or NOMARCH may be preferably provided with a card-holding device which will maintain the withdrawn COUNTERSPELL and AMULET cards and the JUBILEE ABILITY card in a face-up position visible to the NOMARCH with which they are associated but unrevealed to his opponents.

The five ABILITY cards withdrawn from each NOMARCH'S deck of ABILITY cards are held by the card-holding device in a manner rendering them visible to all opponents.

The positive and negative DOMAINS of mover or DJER cards are shuffled separately and placed in separate stacks face-down in front of all participants.

The five SPELL cards of each NOMARCH determine the form of the OUTLANDER associated therewith. The two COUNTERSPELL cards drawn by each NOMARCH determine his two campaign objectives to be accomplished in the playing of the game. Each of the three AMULET cards drawn by each NOMARCH provides a specific defense which may be used by the NOMARCH'S OUTLANDER to prevent annihilation.

Each NOMARCH then positions his respective PYRAMID 70 in the respective starting and finishing space or EARTH 30 of his NOME and positions the corresponding CAPSTONE 68 in the PIT 20 of the game board 10. Play begins with the NOMARCH of the NOME of the Diorite Pyramid 12 and continues in a counterclockwise direction successively to the NOMARCHS of the NOMES 14, 16 and 18 until completion of the game. At the start of the game, each NOMARCH initially turns up his top SPELL card, then using the three proper playing pieces, 36, 42 and 50 forms the OUTLANDER 58, 60, 62, 64 or 66 with which he will commence play. The uppermost DJER card in the positive DOMAIN and the uppermost DJER card in the negative DOMAIN are then simultaneously turned face up. This movement of the DJER cards is called CASTING. The NOMARCH'S OUTLANDER initially starts from the respective EARTH 30 in his NOME.

The participant or NOMARCH selects one or the other of the numerical value symbols shown on the two upturned DJER cards. This selected numerical value symbol represents a numerical value which indicates and determines the number of GATES 26 through which the NOMARCH'S OUTLANDER may pass. If one of the DJER cards CAST is the special positive or negative DJER card illustrated in FIG. 14M or FIG. 14N, the OUTLANDER may be moved to any GALLERY 22 within the NOME in which the OUTLANDER is currently at rest.

Should both special DJER cards illustrated in FIGS. 14M and 14N be CAST simultaneously, the OUTLANDER may be moved to any GALLERY 22 within the four NOMES 12, 14, 16 and 18 of the game board 10. If the cast of the DJER cards reveals a double one, a double two, a double three, a double five or a double eight, the OUTLANDER is entitled to move through only the single number of GATES shown on one of the DJER cards. If the cast of the DJER cards reveals a double zero numerical representation, as illustrated in FIGS. 14A and 14B, the OUTLANDER may pass through 13 GATES 26.

A most important aspect of the CASTING of the DJER cards revealing any double number, zero or blank, or special DJER card is that any such CASTING of the DJER cards also occasions TRANSMOGRIFICATION, or the changing of the form of the OUTLANDER. At such time, the participant or NOMARCH places the faced up SPELL card face-down at the bottom of the SPELL card stack and the uppermost SPELL card is faced up. The new form of OUTLANDER thus revealed is then constructed of the appropriate three playing pieces.

When the NOMARCH'S OUTLANDER has been moved pursuant to the indication of the CAST of the DJER cards, or otherwise as will be described hereinafter, the NOMARCH'S turn is over and the NOMARCH to his right commences his turn.

The two deeds of bravery and craft, mentioned above, involve a DIRECT BLOW on each of two enemy OUTLANDERS from any other NOME as indicated by the two COUNTERSPELL cards drawn prior to the start of the game. A DIRECT BLOW is struck when the movement of an attacking OUTLANDER is terminated in the same GALLERY 22 in which an enemy OUTLANDER is situated. The advantage lies with the attacking OUTLANDER as he can defeat any enemy OUTLANDER of equal or lesser strength or numerical value. The defeating of any enemy OUTLANDER of equal or lesser strength is, however, subject to exception with regard to the previously mentioned ANARCHY ABILITY card as will be described hereinafter. The penalty to an enemy OUTLANDER for being struck a DIRECT BLOW by an attacking OUTLANDER is to be sent crashing back to EARTH. In other words, the defeated OUTLANDER must be immediately moved back to the starting and finishing space or EARTH 30 of its associated NOME immediately and will commence movement therefrom on the next turn of its NOMARCH.

A GLANCING BLOW, not qualifying as a deed of bravery and craft, may be applied by an attacking outlander to an enemy OUTLANDER when the attacking OUTLANDER moves through a GALLERY 22 in which the enemy outlander is situated to another GALLERY 22. The penalty exacted against the opposing NOMARCH whose OUTLANDER has received a GLANCING BLOW is the loss of that NOMARCH'S next turn of play.

An AMULET card allows restoration of an OUTLANDER which has been struck a DIRECT BLOW by an attacking OUTLANDER. If the NOMARCH of the attacked OUTLANDER has drawn an AMULET card in the form of the attacked OUTLANDER it must be shown to all opponents at that time. If the NOMARCH of the attacked OUTLANDER has no AMULET card for that form of OUTLANDER, then the OUTLANDER is annihilated by the DIRECT BLOW and may not be used again. The NOMARCH of the attacked OUTLANDER must remove the SPELL card for the form of the defeated OUTLANDER from the SPELL card stack and discard it for the rest of the game.

When the two enemy OUTLANDER forms, designated by the two COUNTERSPELL cards drawn by a NOMARCH, are successfully attacked and defeated by DIRECT BLOWS from the NOMARCH'S OUTLANDER, the COUNTERSPELL cards of the defeated OUTLANDERS are displayed as a sign of victory by the NOMARCH of the attacking and victorious OUTLANDER. It should be noted, however, that the campaign objectives of each NOMARCH need not be revealed until after a successful attack by an attacking OUTLANDER against an enemy OUTLANDER.

The five ABILITY cards drawn by each NOMARCH prior to the start of the game may be used instead of the mover or DJER card CAST at the discretion of the NOMARCH after his first turn of play. The mover or DJER cards must be used on each NOMARCH'S first turn of play. The ABILITY card must be shown by the NOMARCH to all opponents when it is used. The same ABILITY card may not be used on two successive turns in the game.

As mentioned above, each NOMARCH must, through the action of his OUTLANDER, secure the PYRAMID CAPSTONE 68 for his NOME from the PIT 20 and return it to his starting and finishing space or EARTH 30 to render his PYRAMID 70 whole. In order to secure a CAPSTONE 68 from the PIT 20, the associated OUTLANDER must rest in a GALLERY 22 separated from the PIT 20 by a GATE 26. On his next move, the NOMARCH of such an OUTLANDER may retrieve his CAPSTONE 68 from the PIT 20 by facing up his JUBILEE ABILITY card, illustrated in FIG. 13H, and placing the CAPSTONE 68 on top of his OUTLANDER. The withdrawal of a CAPSTONE from the PIT constitutes one complete turn for the NOMARCH. On that NOMARCH'S next turn, he may utilize DJER cards or ABILITY cards to escort his CAPSTONE 68 back to the starting and finishing space or EARTH 30 of his NOME with his OUTLANDER. The journey of the OUTLANDER with the CAPSTONE 68 must be made through all three of the enemy NOMES. If an OUTLANDER escorting a CAPSTONE should be struck a DIRECT BLOW by an attacking enemy OUTLANDER, the escorting OUTLANDER is sent crashing back to the starting and finishing space or EARTH 30 of its NOME but the CAPSTONE 68 remains in the space 22 where the attack occurred to await the return of its escorting OUTLANDER. An unescorted CAPSTONE 68 is not returned to the PIT 20 even though its escorting OUTLANDER has been attacked and defeated by an enemy OUTLANDER.

It will be understood that the NOMARCH whose OUTLANDER has successfully attacked and defeated two enemy OUTLANDERS and retrieved his CAPSTONE and escorted it successfully through the three enemy NOMES back to his starting and finishing space or EARTH 30 to complete the PYRAMID 70 is the winner of the game.

Changes may be made in the construction and arrangement of parts or elements as heretofore set forth in the specification for playing the board game of the present invention as well as in the rules and mode of play of the board game of the present invention without departing from the spirit and scope of the invention as defined in the following claims.

What is claimed is:

1. A board game apparatus comprising:

a game board having a playing surface divided into a plurality of playing areas surrounding a center section, each playing area comprising:

a plurality of playing spaces formed on the playing surface thereof;

a plurality of blank spaces formed on the playing surface thereof and separating said playing spaces one from the other;

a plurality of passage indicia means formed on the playing surface within certain of said blank spaces for indicating passages from one playing space to another through said blank spaces; and means thereon for visually distinguishing each said playing area from each of the other playing areas;

a plurality of playing piece sets corresponding in number to the number of playing areas, each playing piece set comprising a plurality of playing pieces each bearing means thereon for visually identifying said pieces with one of said playing areas, the plurality of pieces in each said set being so constructed and arranged to be selectively combinable to construct at least two forms of a playing entity positionable on and movable over said game board playing surface and sized to fit within any playing space, and each of the plurality of playing pieces in each set bearing indicia means thereon for visually indicating the identity of a playing entity constructed by the selective combination of said playing pieces;

playing entity form identification means having indicia thereon for indicating the identity of each playing entity form visually identified with a playing area of said game board to be constructed by the combination of said set of playing pieces visually identified with the playing area;

enemy playing entity form identification means having indicia thereon for indicating, for each of said playing entities, the identity of at least one opposing playing entity form to be attacked by each of said playing entities;

protected playing entity form identification means having indicia thereon for indicating, for each of said playing entities, the identity of at least one of the forms of each of said playing entities which is protected from attack by opposing playing entities;

playing entity movement indication means having indicia thereon for indicating, for each of said playing entities, the movement of each of said playing entities over the playing surface of said game board; and a plurality of indicia means, corresponding in number to the number of playing areas and having means thereon for visually identifying each of said indicia means with a respective associated playing area, for moving over the playing surface of said game board between the center section of said game board and the starting and finishing spaces of the playing areas.

2. The board game apparatus as defined in claim 1 wherein said plurality of playing areas are four in number and are substantially identical in appearance, said playing areas being in contiguous relation.

3. The board game apparatus as defined in claim 2 wherein each game board playing area includes 34 playing spaces and wherein the plurality of passage indicia means in each playing area are 76 in number.

4. The board game apparatus as defined in claim 3 wherein each game board playing area is rectangular in shape and is characterized further to include:

eight sun chambers, each sun chamber consisting of one playing space surrounded by four passage indicia means; and five star gates, each star gate occurring at the junction of four passage indicia means.

5. The board game apparatus as defined in claim 1 wherein the plurality of playing pieces of each of said playing piece sets comprises:

one playing piece having indicia means thereon for indicating a numerical value of three;

two playing pieces each having indicia means thereon for indicating a numerical value of two; and three playing pieces each having indicia means thereon for indicating a numerical value of one.

6. The board game apparatus as defined in claim 5 wherein said playing entity form identification means is characterized further to include:

a plurality of spell cards, each spell card having indicia thereon indicating the identity of the playing entity form for the corresponding playing area.

7. The board game apparatus as defined in claim 6 wherein said enemy playing entity form identification means is characterized further to include:

a plurality of counterspell cards, each counterspell card having indicia thereon indicating the identity of one opposing playing entity form to be attacked.

8. The board game apparatus as defined in claim 7 wherein said protected playing entity form identification means is characterized further to include:

a plurality of amulet cards; each amulet card having indicia thereon indicating the identity of one opposing form of a playing entity which is protected against attack by opposing playing entities.

9. The board game apparatus as defined in claim 1 wherein said playing entity movement indication means comprises a plurality of mover cards having indicia thereon representing various numerical values.

10. The board game as defined in claim 9 wherein said plurality of mover cards is characterized further to include:

nine positive mover cards each having indicia thereon symbolically representing a numerical value of zero;

nine negative mover cards each having indicia thereon symbolically representing a numerical value of zero;

nine positive mover cards each having indicia thereon symbolically representing a numerical value of one;

nine negative mover cards each having indicia thereon symbolically representing a numerical value of one;

nine positive mover cards each having indicia thereon symbolically representing a numerical value of two;

nine negative mover cards each having indicia thereon symbolically representing a numerical value of two;

nine positive mover cards each having indicia thereon symbolically representing a numerical value of three;

nine negative mover cards each having indicia thereon symbolically representing a numerical value of three;

nine positive mover cards each having indicia thereon symbolically representing a numerical value of five;

nine negative mover cards each having indicia thereon symbolically representing a numerical value of five;

nine positive mover cards each having indicia thereon symbolically representing a numerical value of eight;

nine negative mover cards each having indicia thereon symbolically representing a numerical value of eight;

one positive special mover card having indicia thereon symbolically representing no numerical value;

one negative special mover card having indicia thereon symbolically representing no numerical value; and said positive mover cards and said positive special mover card having coloring of the indicia thereon contrasting with coloring of the indicia on said negative mover cards and said negative special mover card.

11. The board game apparatus as defined in claim 10 wherein said playing entity movement indication means is characterized further to include:

a plurality of ability cards, each ability card having indicia thereon symbolically indicating on its face a special movement which can be made by the respective playing entity over the playing surface of said game board.

12. The board game apparatus as defined in claim 1 wherein said plurality of indicia means correspond in number to the number of playing areas and have means thereon for visually identifying each of said indicia means with a respective associated playing area, for moving over the playing surface of said game board between the center section of said game board and the starting and finishing spaces of the playing areas, is characterized further to include a plurality of pyramid capstones, each associated with a respective playing area.

13. The board game apparatus as defined in claim 1 wherein each identical playiing area of the playing surface of said game board is identified by a distinctive color.

14. A board game apparatus comprising:

a game board having a playing surface divided into a plurality of identical playing areas surrounding a center section, each playing area comprising a plurality of playing spaces formed on the playing surface and separated one from the other by a plurality of blank spaces formed on the playing surface and having a plurality of passage indicia means formed within certain blank spaces for indicating passages therethrough from one playing space to another, and a starting and finishing space;

a plurality of playing piece sets each associated by visual identification means thereon with a respective playing area, each said playing piece set comprising a plurality of playing pieces so constructed and arranged to be selectively superimposable to construct at least two forms of a playing entity positionable on and movable over said game board playing surface and sized to fit within any playing space on said game board;

playing entity form identification means having indicia thereon for indicating the identity of each playing entity form visually identified with each playing area of said game board;

enemy playing entity form identification means having indicia thereon for indicating, for each of said playing entities, the identity of at least one opposing playing entity form to be attacked by each of said playing entities;

protected playing entity form identification means having indicia thereon for indicating, for each of said playing entities, the identity of at least one of the forms of each of said playing which is protected from attack by opposing playing entities;

playing entity movement indication means having indicia thereon for indicating, for each of said playing entities, movement of each of said playing entities over the playing surface of said game board; and a plurality of indicia means, each associated by visual identification means thereon with a respective playing area, for moving over the playing surface of said game board between the center section of said game board and the starting and finishing space of the respective playing area.

* * * * *

PO-1050
(5/69)

UNITED STATES PATENT OFFICE
CERTIFICATE OF CORRECTION

Patent No. 4,004,809 Dated January 25, 1977

Inventor(s) Gerald A. Schreiber

It is certified that error appears in the above-identified patent and that said Letters Patent are hereby corrected as shown below:

Column 9, lines 66 and 67, "outlander", first occurrence, should be --OUTLANDER--.

Column 10, line 1, "outlander" should be --OUTLANDER--.

Column 13, line 48, "correspond" should be --corresponding--; and line 49, "have" should be --having--.

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*